US009153222B1

(12) United States Patent
Wong

(10) Patent No.: US 9,153,222 B1
(45) Date of Patent: Oct. 6, 2015

(54) PLUCKED STRING PERFORMANCE DATA GENERATION DEVICE

(71) Applicant: Kam Kwan Wong, Hong Kong (HK)

(72) Inventor: Kam Kwan Wong, Hong Kong (HK)

( * ) Notice: Subject to any disclaimer, the term of this patent is extended or adjusted under 35 U.S.C. 154(b) by 0 days.

(21) Appl. No.: 14/326,491

(22) Filed: Jul. 9, 2014

(30) Foreign Application Priority Data

Apr. 2, 2014 (CN) ..... 2014 1 0132005

(51) Int. Cl.
*G10H 1/44* (2006.01)

(52) U.S. Cl.
CPC ..... *G10H 1/44* (2013.01); *G10H 2220/415* (2013.01)

(58) Field of Classification Search
CPC . G10H 3/06; G10H 1/0553; G10H 2220/305; G10H 2220/411; G10H 2220/415; G10H 2220/421; G10H 2220/405; G10H 2230/125; G10H 2220/061
USPC ..... 84/724
See application file for complete search history.

(56) References Cited

U.S. PATENT DOCUMENTS

| | | | | | |
|---|---|---|---|---|---|
| 4,968,877 | A * | 11/1990 | McAvinney et al. | ..... | 250/221 |
| 5,296,641 | A * | 3/1994 | Stelzel | ..... | 84/602 |
| 5,369,270 | A * | 11/1994 | Gurner et al. | ..... | 250/221 |
| 5,442,168 | A * | 8/1995 | Gurner et al. | ..... | 463/36 |
| 5,668,333 | A * | 9/1997 | Horton et al. | ..... | 84/470 R |
| 6,489,550 | B1 * | 12/2002 | Takahashi et al. | ..... | 84/724 |
| 2003/0230187 | A1 * | 12/2003 | Ishida et al. | ..... | 84/741 |
| 2009/0221369 | A1 * | 9/2009 | Riopelle | ..... | 463/35 |
| 2012/0272813 | A1 * | 11/2012 | Moon | ..... | 84/645 |

* cited by examiner

*Primary Examiner* — Jeffrey Donels

(57) ABSTRACT

The present invention relates to a plucked string performance data generation device, including a MIDI input interface used for receiving MIDI data, a plurality of infrared emitters and a plurality of infrared receivers used for forming infrared strings distributed radially in form of a sector, and an infrared emitter and an infrared receiver used for a mute switch, a microcontroller used for generating MIDI data from chord data acquired from the MIDI input interface and interrupt data of the infrared strings, a MIDI output interface connected with the microcontroller, and touch pads mounted onto corresponding infrared receivers. The device has an infrared string layout in form of a sector and the touch pads arranged above infrared string sensors to form a dual sensors, where appropriate, a user may use different sensors to control the same target, whereby realizing simulation of sound of a string instrument and facilitating the use thereof.

9 Claims, 8 Drawing Sheets

PLUCKED STRING PERFORMANCE DATA GENERATION DEVICE

CROSS REFERENCE TO RELATED APPLICATIONS

The present application claims the benefit of Chinese Patent Application No. 201410132005.X filed on Apr. 2, 2014; the contents of which are hereby incorporated by reference.

FIELD OF THE INVENTION

The present invention relates to the field of music, and more particularly to a plucked string performance data generation device.

BACKGROUND OF THE INVENTION

Since the release of the Musical Instrument Digital Interface (or MIDI for short) in 1982, various electronic keyboard or musical instruments appear in succession. These musical instruments are very powerful in functions, and can realistically simulate performances of many different musical instruments. However, due to the nature of the keyboard type musical instruments, it is very difficult for such electronic musical instruments to simulate the performances of a rhythm guitar.

SUMMARY OF THE INVENTION

One object of the present invention is to provide a plucked string performance data generation device capable of simulating performance of string musical instruments. To this end, the present invention provides a plucked string performance data generation device, comprising: a MIDI input interface used for receiving MIDI data; a plurality of infrared emitters and a plurality of infrared receivers used for forming infrared strings distributed radially in form of a sector, wherein the infrared strings are distributed in a radial pattern to form a sector; a microcontroller used for generating MIDI data from chord data acquired from the MIDI input interface and interrupt data of the infrared strings; and a MIDI output interface connected with the microcontroller.

As an improvement scheme, in a step of converting the input data into the chord data, converting only the input data within a chord input detection range into the chord data, and outputting integrally the input data outside the chord input detection range and the MIDI data.

As an improvement scheme, the plucked string performance data generation device further comprises tactile sensors or touch pads connected with the microcontroller, and used for detecting the pressing velocity, wherein the touch pads are mounted onto corresponding infrared receivers.

As an improvement scheme, the plucked string performance data generation device further comprises a mute switch connected with the microcontroller, wherein an infrared emitter of the mute switch is mounted to a position adjacent to the plurality of infrared emitters.

As an improvement scheme, the plucked string performance data generation device further comprises a bass string touch pad connected with the microcontroller, wherein the touch pad is mounted onto the infrared emitter of the mute switch.

As an improvement scheme, the plucked string performance data generation device further comprises a sustain knob connected with the microcontroller, and used for controlling the sustaining time of notes.

As an improvement scheme, the plucked string performance data generation device further comprises a string velocity knob connected with the microcontroller, and used for controlling the maximum down beat note velocity for plucking infrared strings.

As an improvement scheme, the plucked string performance data generation device further comprises a pad velocity knob connected with the microcontroller, and used for controlling the maximum note velocity of the touch pad.

As an improvement scheme, the plucked string performance data generation device further comprises a keyboard control mode selection switch connected with the microcontroller.

As an improvement scheme, the distance between adjacent infrared emitters is between 0.7 cm and 1.7 cm, and the distance between adjacent infrared receivers is between 1.5 cm and 3.0 cm.

As an improvement scheme, the length of each of infrared strings is between 3.5 cm and 7.5 cm.

As an improvement scheme, the outer diameter of the touch pad is between 0.8 cm and 2.0 cm.

The plucked string performance data generation device provided by the preferred embodiment of the present invention has an infrared string layout in form of a sector and has the touch pads arranged above infrared string sensors to form a dual sensors (infrared string sensors and touch pads), where appropriate, a user may use different sensors to control the same target (for example, for playing of a specific string), whereby realizing simulation of sound data of string instruments and facilitating the use thereof.

It should be noted that, the external MIDI input device required by the present invention is not limited to as a MIDI keyboard, and it may also be any other device capable of outputting proper MIDI data. For example, a MIDI guitar controller is formed by integrating the present invention with a proper MIDI guitar timbre module and then updating the software in the microcontroller.

BRIEF DESCRIPTION OF THE DRAWINGS

To illustrate more clearly the technical solution of the embodiments of the present invention or the prior art, the drawings for use with the embodiments or the prior art are described briefly below. Apparently, the drawings referred to in the following description merely show some embodiments of the present invention, and a person skilled in the art may further derive other drawings from the attached drawings without any creative work.

DETAILED DESCRIPTION OF EMBODIMENTS OF THE INVENTION

The preferred embodiments of the present invention will be described below with reference to the accompanying drawings.

Figure 1:
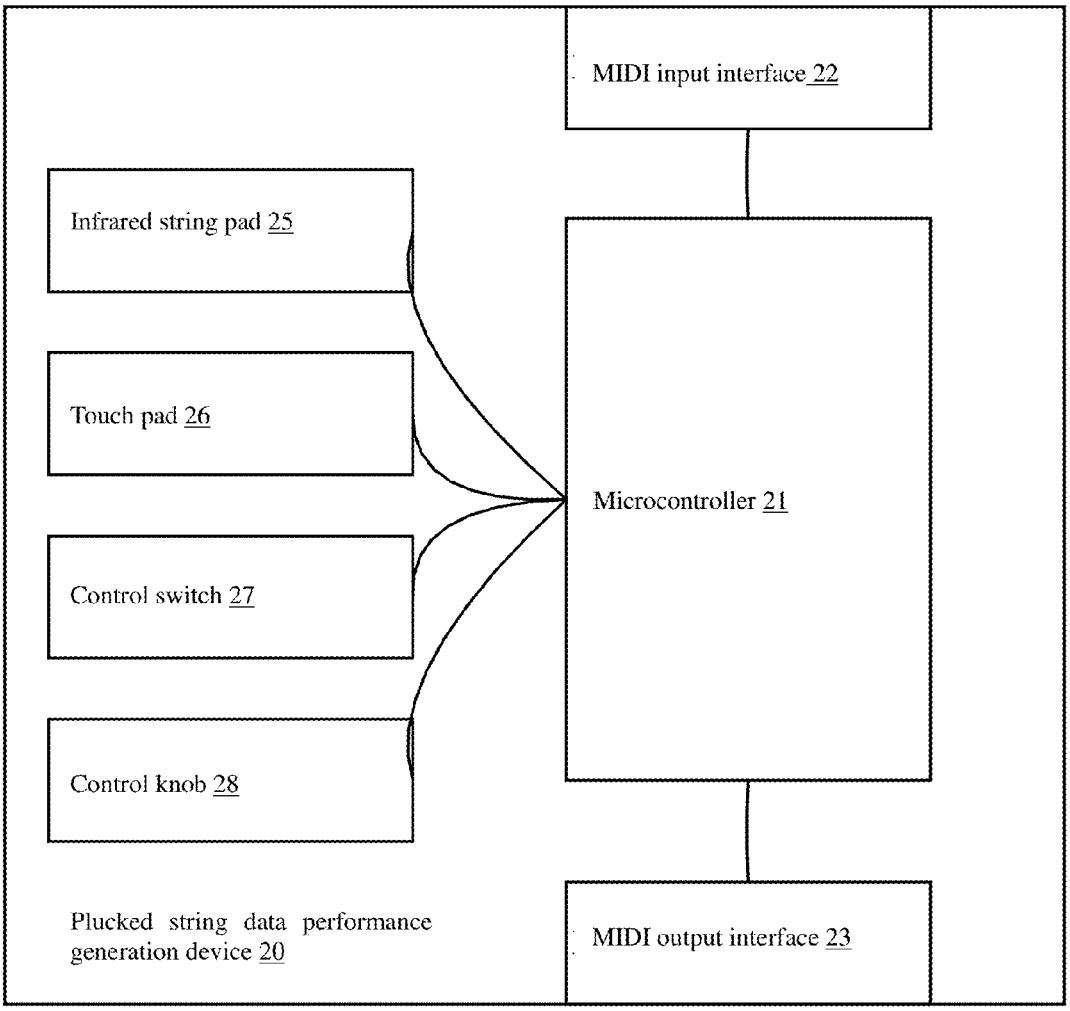
FIG. 1 is a block diagram of a plucked string performance data generation device provided by the present invention.
Figure 2:
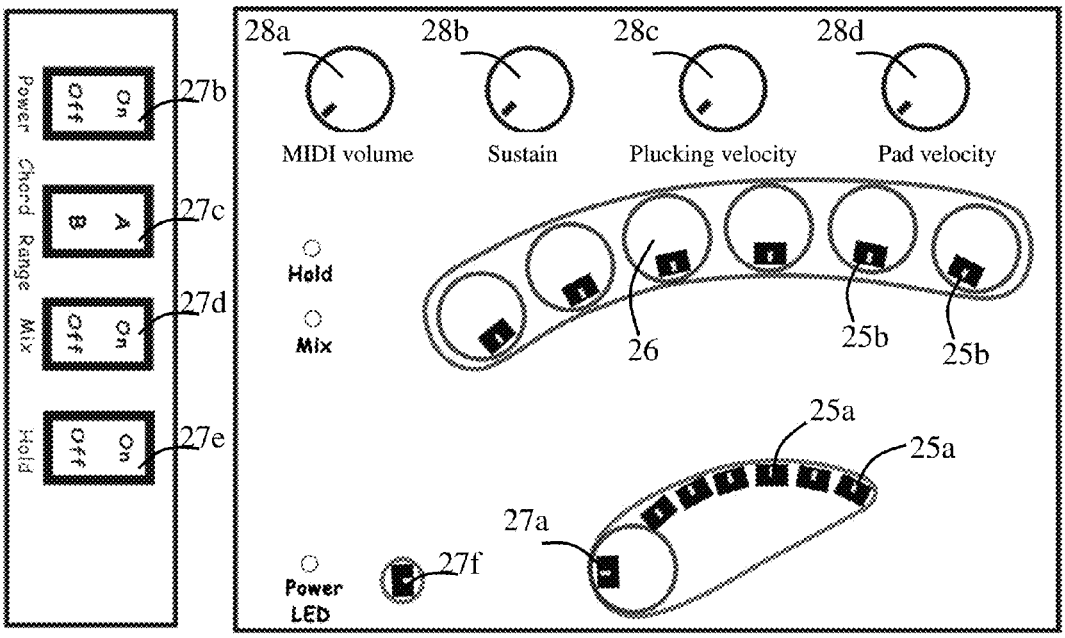
FIG. 2 illustrates the front side and the lateral side of a plucked string performance data generation device provided by an embodiment of the present invention.
Figure 3:
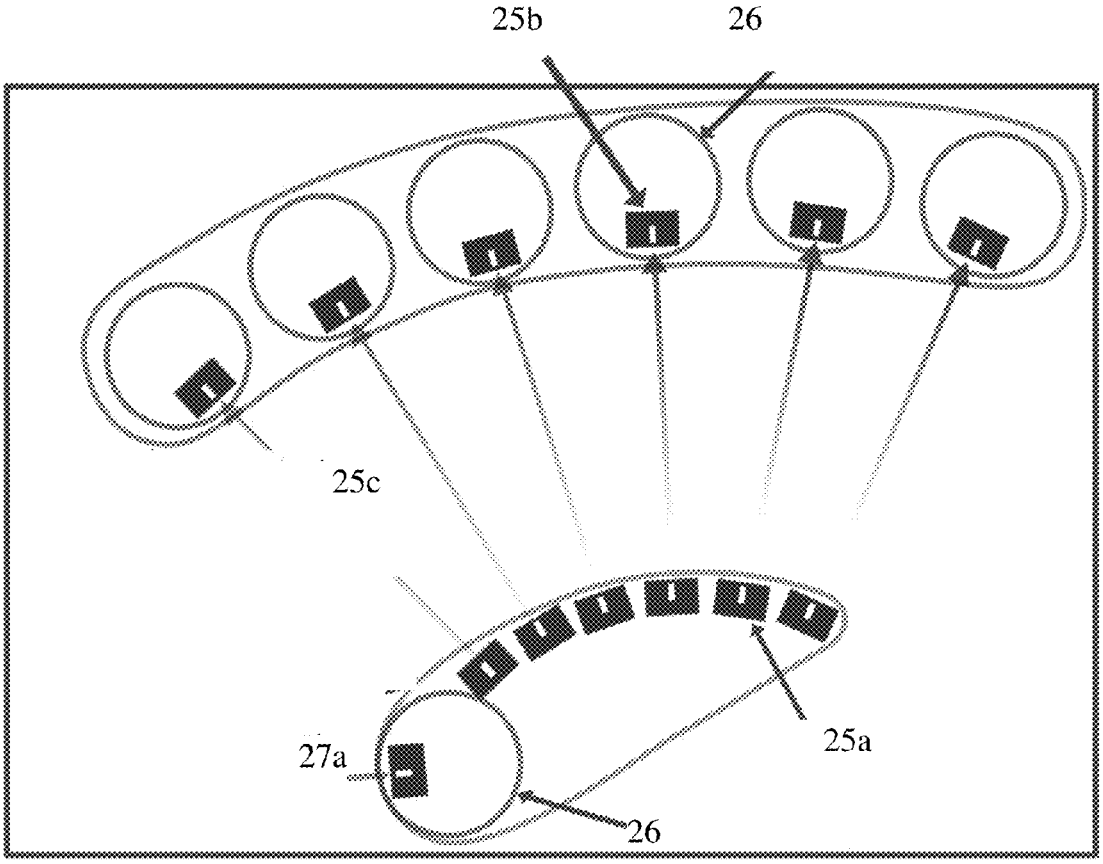
FIG. 3 and FIG. 4 illustrate the front side of the plucked string performance data generation device as illustrated in FIG. 2.

Referring to FIG. 1 to FIG. 3, a plucked string performance data generation device 20 provided by the present embodiment comprises: a microcontroller 21 and a MIDI input interface 22, a MIDI output interface 23, an infrared string sensing device 25, one or more tactile sensors/touch pads 26 and control modules such as a control switch 27 and a control knob 28, and the like, which are connected with the microcontroller 21.

The MIDI input interface 22 is used for connection with an external device, such as a MIDI keyboard, so as to receive input of chord data and other performance data.

The infrared string sensing device 25 comprises a plurality of infrared emitters and a plurality of infrared receivers which are mainly used for generating infrared strings and detecting the on/off state of the infrared strings, and calculating the plucking time and velocity according to the on/off time of each infrared ray beams.

The touch pad 26 is used for detecting the pressing force/velocity. It will be very difficult for an instrumentalist to pluck an independent infrared string while the instrumentalist needs to pluck a single independent string. Therefore, a touch pad (Touch Pads) is arranged for facilitating the plucking of the single independent string.

The control module such as the control switch 27 and the control knob 28 is connected with the microcontroller 21 for enabling more settings and control over the plucked string performance data generation device 20. For example, the control module may input at least one of the following parameters to integration module or the microcontroller 21: chord input detection range, flag for mix (yes or no), flag for controlling down beat/up beat through MIDI keyboard (yes or no), flag for controlling mute through MIDI keyboard (yes or no), sustaining time, string velocity range for down beat, string velocity range for up beat, pad velocity range, and volume.

FIG. 2 illustrates the front side and the lateral side of the plucked string performance data generation device provided by the embodiment. FIG. 3 illustrates the front side of the plucked string performance data generation device. In the embodiment, the infrared string sensing device 25 comprises six infrared emitters 25*a* and six infrared receivers 25*b*, wherein the infrared rays emitted by the infrared emitter 25*a* can be received and sensed by the respective infrared receiver 25*b*. Six infrared strings 25*c* are distributed radially in form of a sector. Compared with a traditional parallel string structure, the string structure distributed in the form of a sector provided by the present embodiment is more convenient for a user to pluck.

The touch pad 26 is mounted onto respective infrared receivers 25*b* to form a dual sensors (infrared string sensor and touch pad), where appropriate, a user may use different sensors to control the same target (for example, for playing of a specific string), whereby realizing simulation of sound data of a string instrument and facilitating the use thereof.

The front side of the plucked string performance data generation device is also provided with a mute switch comprising an infrared emitter 27*a* and an infrared receiver 27*f*, wherein the infrared emitter 27*a* is mounted at a position adjacent to the infrared emitter 25*a*. A MIDI volume knob 28*a*, a sustain knob 28*b*, a string velocity knob 28*c* and a pad velocity knob 28*d* are further arranged near the infrared receiver 26*b*. Wherein, the MIDI volume knob 28*a* is used for controlling the volume of the MIDI, the sustain knob 28*b* is used for controlling the sustaining time of the infrared string, the string velocity knob 28*c* is used for controlling the maximum down beat note velocity for plucking the infrared string, and the pad velocity knob 28*d* is used for controlling the maximum note velocity of the touch pad. The touch pad mounted onto the infrared emitter 27*a* of the mute switch is an additional bass string touch pad (the touch pad 1 in FIG. 4) for facilitating a user to pluck and input the lowest note of the chord (note: the number of strings used for guitar chords are not fixed, wherein some guitar chords may use all the six strings, and some guitar chords only use five strings and even use four strings, and thus, the bass string is not fixed).

Preferably, the front side of the plucked string performance data generation device is provided with a power switch indicator light above which a keyboard control mode (Hold) indicator light and a mix (Mix) indicator light are also arranged.

The lateral side of the plucked string performance data generation device is provided with a power switch 27*b*, a chord range (Chord Range) selection switch 27*c*, a mix switch 27*d*, a keyboard control mode (Hold) selection switch 27*e*, and the like. The power switch 27*b* is used for controlling the on and off of a power supply. The chord range selection switch 27*c* is used for selecting the chord input range. More particularly, the chord range selection switch 27*c* may select different chord input detection ranges with respect to MIDI keyboards with different number of keys. The mix (Mix) switch 27*d* is used for determining whether the chord input part of the MIDI keyboard should be played and output via the MIDI output interface. The keyboard control mode (Hold) selection switch 27*e* is used for selecting whether to control the down beat/up beat through the MIDI keyboard or control the mute through the MIDI keyboard.

In the embodiment, different parameters are set through the control module including the control switches and the control knobs as follows.

(1) Chord Range Selection Switch

Namely, different chord input detection ranges may be selected corresponding to the MIDI keyboards with different number of keys. (For example, F1-E3 may be selected as the chord detection range for a MIDI keyboard with 49 keys).

(2) Mix Switch

Namely, whether the chord input part of the MIDI keyboard should be played and output via the MIDI output interface.

(3) Keyboard Control Mode (Hold) Selection Switch

Namely, use the MIDI keyboard to control the palm mute (Palm Mute) effect or use the MIDI keyboard to control the volume of the down beat (Down beat)/up beat (Up beat). The keyboard control mode switch may output different plucking effects under different states. More particularly:

a: when the keyboard control mode selection switch=Off, the string velocity knob 28*c* controls the plucking velocity, and the sustain knob controls the sustaining time of the strings; however, when the hand of the user leaves the MIDI keys (namely, inputting no chord data), the sustaining time may be much shorter than the sustaining time when the MIDI keys are pressed, thus resulting in the palm mute (Palm Mute) effect;

b: when the keyboard control mode selection switch=On, the sustaining time of the string controlled by the sustain knob may not be changed after the hand of the user leaves the MIDI keys. When the hand of the user presses the MIDI keys to input chord data, the velocity range is controlled by the string velocity knob 28*c*. However, when the hand of the user leaves the MIDI keys, the velocity range is controlled by the pad velocity knob 28*d*. Under this mode, the user may use the MIDI keys to control the volume of the down beat (Down beat) and up beat (Up beat).

(4) Mute (Mute) Infrared Ray Sensing Switch

This infrared mute switch is used for controlling the palm mute (Palm Mute) effect so as to better simulate the effect of muting the strings with the fretting hand (Palm Muting) performed on occasion by the guitar player.

(5) Sustain (Sustain) Knob

The knob is used for controlling the sustaining time of the string.

(6) String Velocity and Down Beat (Down Beat) String Velocity (String Velocity) Knob The knob not only controls the maximum note velocity (Maximum MIDI Note Velocity) for plucking the infrared strings, but also controls the velocity of pressing the MIDI keys by the hand when the keyboard control mode selection switch=On.

(7) Pad Velocity (Pad Velocity) and Up Beat (Up Beat) String Velocity Knob

The knob not only controls the maximum note velocity (Maximum MIDI Note Velocity) of the touch pads, but also controls the string velocity when the MIDI keys are not pressed by the hand and the keyboard control mode selection switch=On.

(8) Volume (Volume) Knob

The volume knob is used for controlling the output volume of the MIDI.

Figure 4:
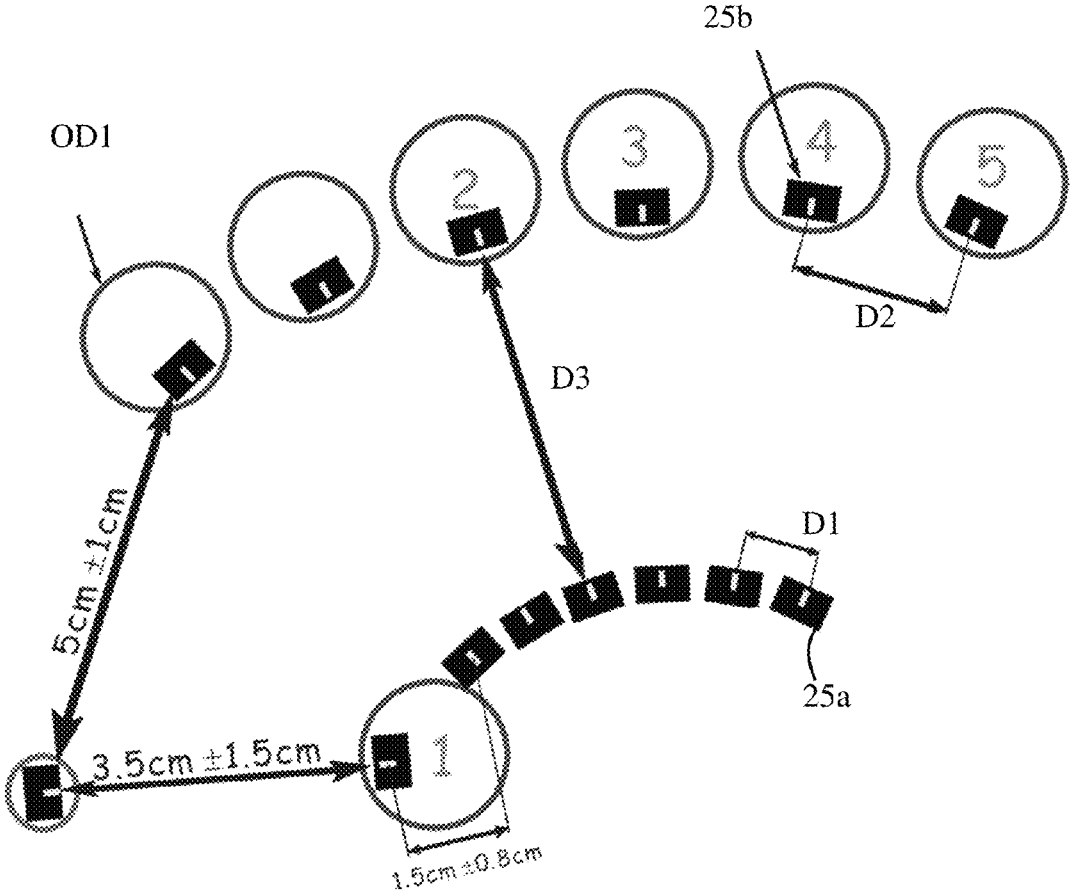

Referring to FIG. 4, the distance D1 between adjacent infrared emitters is between 0.7 cm and 1.7 cm, and the distance D2 between adjacent infrared receivers is between 1.5 cm and 3.0 cm, so as to enable the user to use them in a more convenient and accurate way. The length D3 of each of infrared strings is between 3.5 cm and 7.5 cm. The outer diameter OD1 of the touch pad is between 0.8 cm and 2.0 cm.

Figure 5:
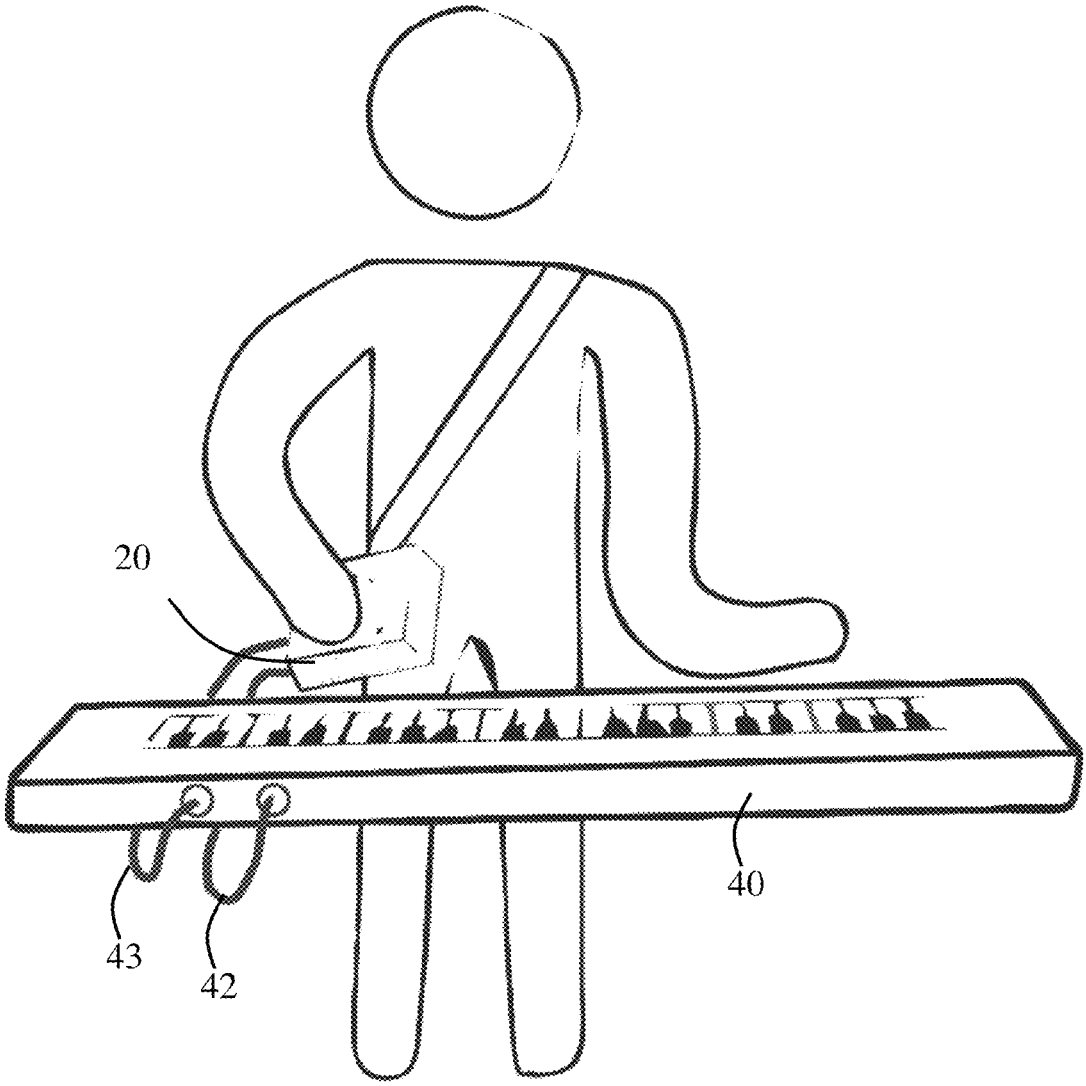
FIG. 5 and FIG. 6 are different embodiments of the plucked string performance data generation device of the present invention.

As illustrated in FIG. 5, the plucked string performance data generation device 20 may exist independently, and may be carried along with the user. Moreover, the plucked string performance data generation device may be connected with a MIDI synthesizer 40 through a MIDI input cable 42 and a MIDI output cable 43.

Figure 6:
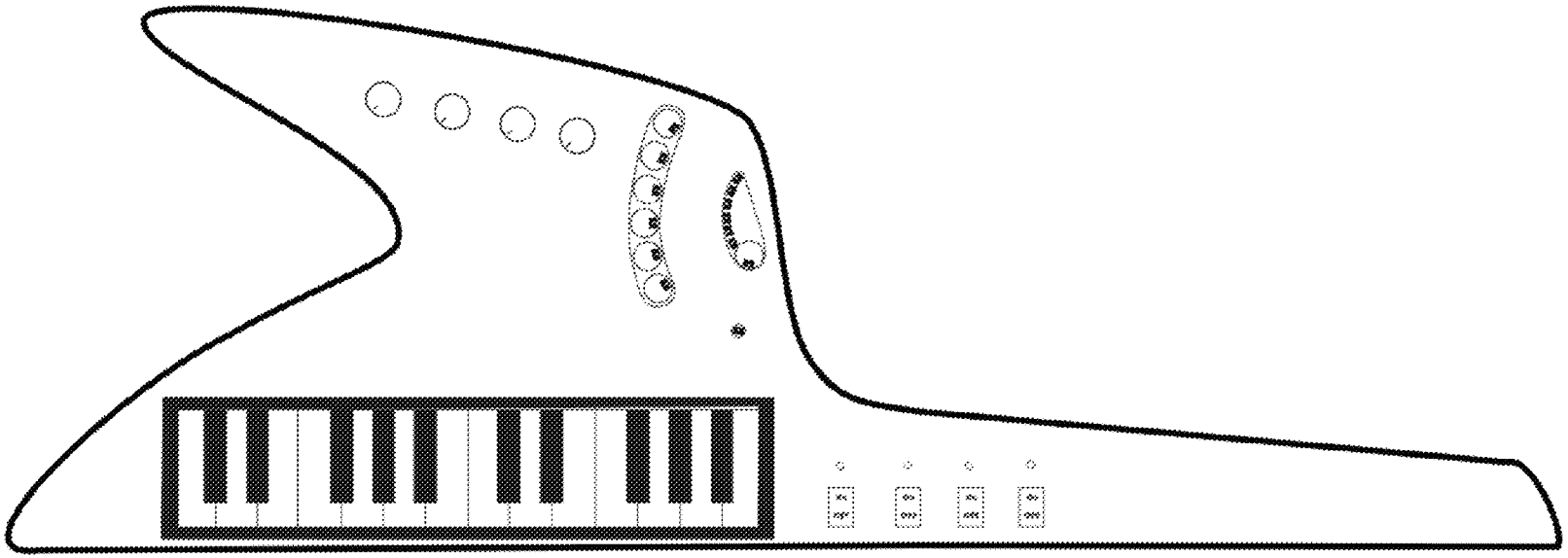

Further, as illustrated in FIG. 6, the plucked string performance data generation device 20 may be mounted or integrated into a MIDI keyboard device.

Figure 7:
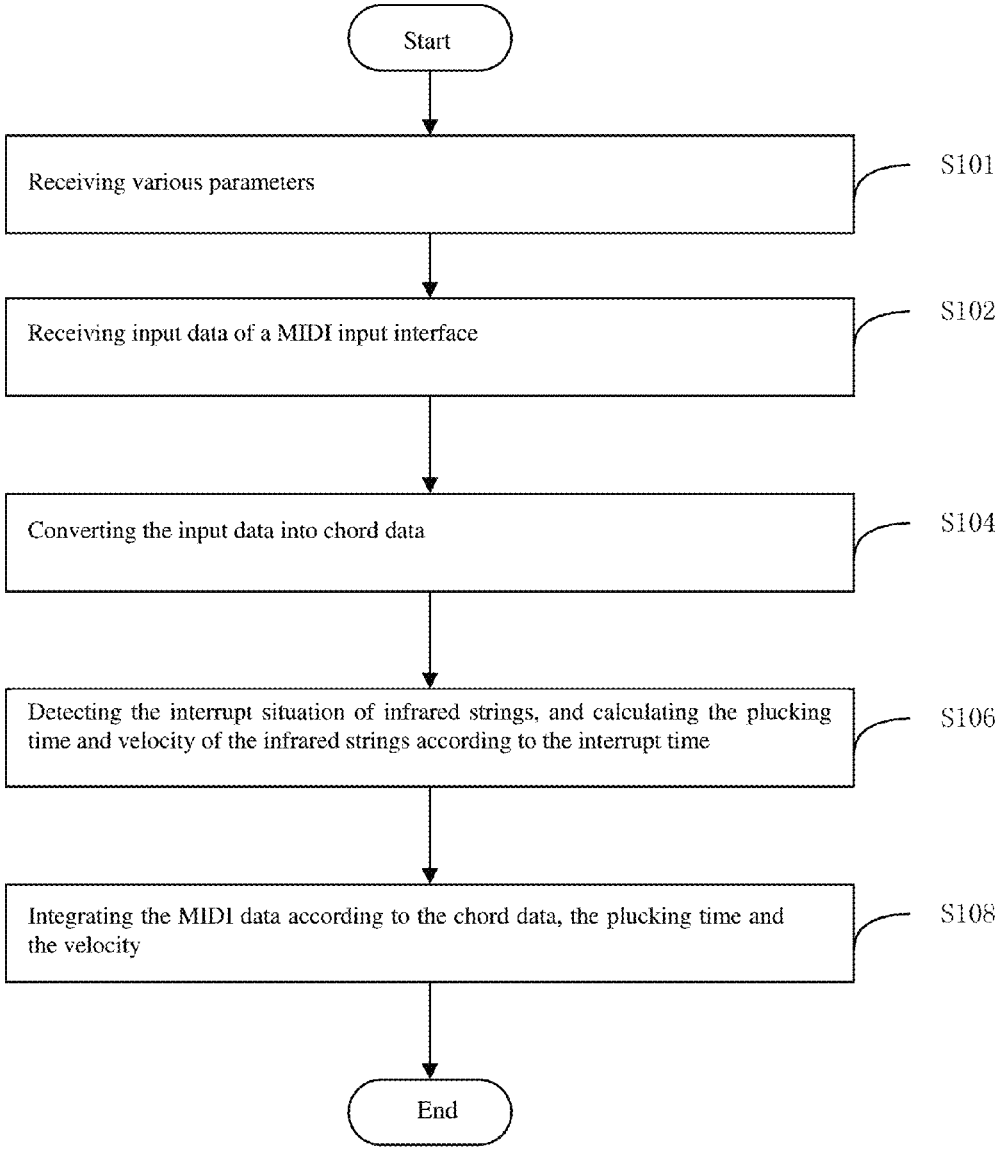
FIG. 7 is a flow chart of a plucked string performance data generation method of the present invention.

The foregoing various control switches and control knobs are used for inputting various setting parameters to the plucked string performance data generation device. The plucked string data generation process of the plucked string performance data generation device is as illustrated in FIG. 7.

Step S101: Receiving various setting parameters. The parameters comprise one or more of the followings: chord input detection range, mix flag (yes or no), up beat flag (yes or no), down beat flag (yes or no), mute flag (yes or no), sustaining time, string down beat range, string up beat range, pad velocity range, and volume.

Step S102: Receiving input data of MIDI.

Step S104: Converting the input data into chord data, for example, guitar chord data. More particularly, if three keys G, C, E within the chord input range of the MIDI keyboard are pressed, the microcontroller 21 will convert the keys into C chord. If the user only presses one key, the microcontroller 21 may convert the key data into corresponding power chord (Power Chord). If the user does not press key or the user inputs invalid data, the microcontroller 21 may adopt the guitar chord (not Power Chord) input last time as the current guitar chord for use. It should be noted that the present invention may comprise but not limited to conversion of the input data into the guitar chord data.

Step S106: Detecting the interrupt situation of the infrared string, and calculate the plucking time and the velocity of the infrared string according to the interrupt time. The specific detection method will be described hereinafter with reference to FIG. 6.

Step S108: Integrating the MIDI data according to the chord data, the plucking time, the velocity, and the like.

Figure 8:
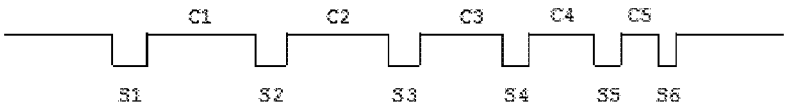
FIG. 8 is a schematic view of an interrupt situation of infrared strings.

Referring to FIG. 8, the microcontroller 21 detects the on/off state of each infrared strings, and may obtain the plucking time and velocity of each string according to the on/off time value of each infrared string after calculation, which is as illustrated in FIG. 8.

(1) When the string is not plucked, the infrared receiver is at the on state under the irradiation of the infrared ray beam. When the string is plucked, the infrared receiver turns into the off state.

(2) When a finger is swept across the six simulated strings, a switch signal similar to the same shown in the foregoing figure may be obtained.

(3) In the figure, the width of S1 represents the time duration or value of the first infrared string under the off state due to the sweeping of the finger. This time value may represent the string velocity of the first infrared string. The larger the string velocity is, the faster the finger move, and the smaller the S1 is. (And so on for S2 to S6).

(4) C1 represents the time value for sweeping from the first string to the second string. (And so on for C2 to C5).

As an improvement, in the foregoing step S104, only the input data within the chord input detection range is converted into chord data, and the input data outside the chord input detection range is integrated and output with the MIDI data (step S108).

As another improvement, it may further comprise the step of respective touch pad is pressed and the pressing velocity thereof, and then transmitting the data to the microcontroller for processing, and integrating the velocity data for performing the MIDI data integration in step S108.

Figure 9:
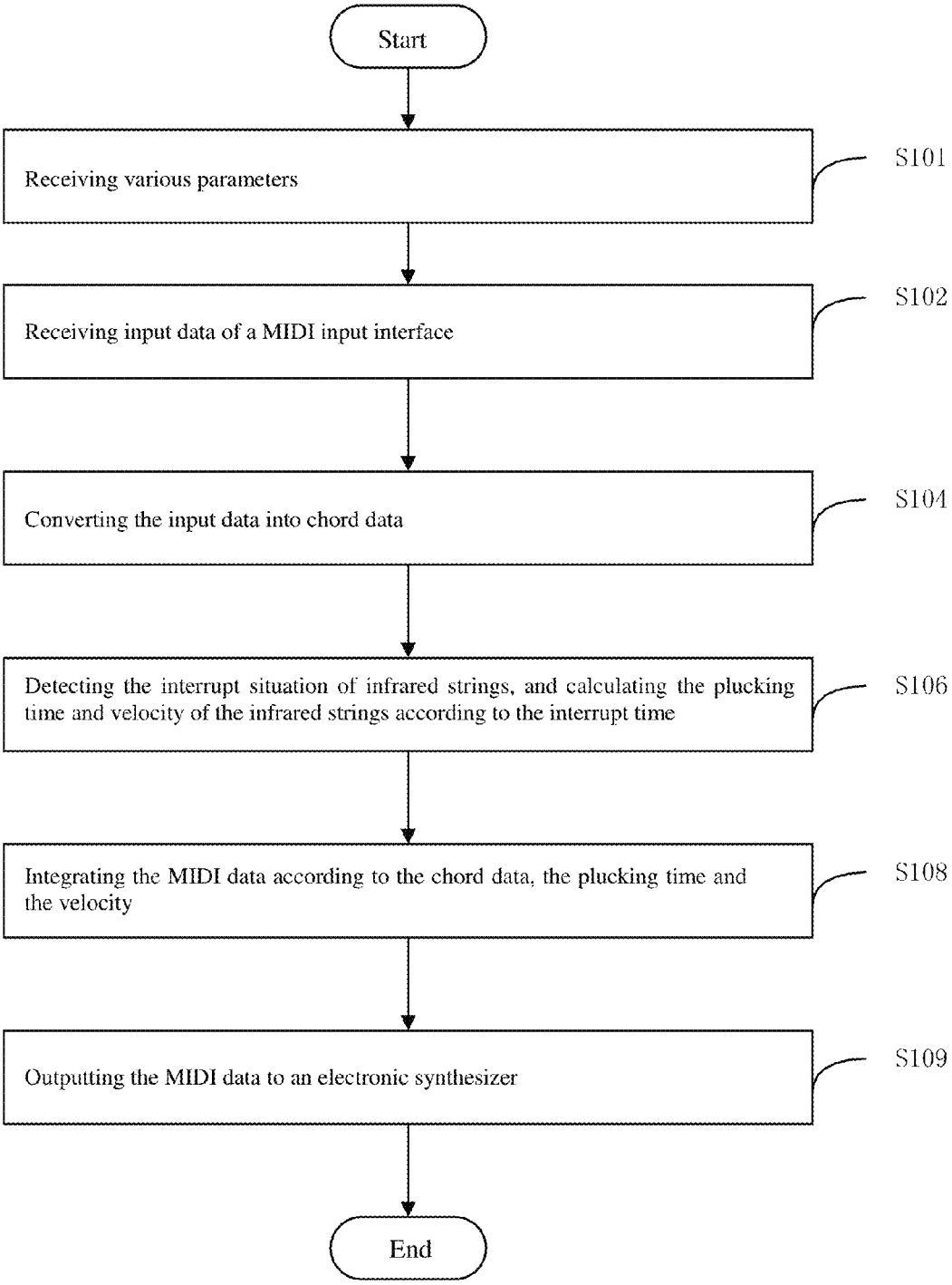
FIG. 9 is a flow chart of a plucked string performance data generation method provided by another embodiment of the present invention.

FIG. 9 is a flow chart of a plucked string data generation method provided by one embodiment of the present invention. Compared with the flow chart of the method as illustrated in FIG. 7, the present embodiment mainly increases a step S109 after the step S108: outputting the MIDI data to an electronic synthesizer to reproduce sound. The electronic synthesizer may be a personal computer, or a dedicated MIDI synthesizer.

It should be noted that the foregoing principle and embodiments of the present invention may be applied to almost all plucked string (Plucked String) musical instruments, such as a banjo (Banjo), zither, pipa, and the like. Because the most fundamental distinctions of these musical instruments are as follows:

(1) Number of strings (for example, the banjo has 4-6 strings, the pipa has 4 strings, and the zither has 16 and even more strings).

(2) The pitch of each string. For example, the standard tunings (Standard Tuning) of six strings of a guitar are respectively E2(82 Hz), A2(110 Hz), D3(147 Hz), G3(196 Hz), B3(247 Hz) and E4(330 Hz).

(3) The impacts of the input chord (note) data on the pitch of each string. For example, when inputting the G chord, the pitches of the six strings of the guitar may be converted to G2, B2, D3, G3, B3 and G4.

Therefore, most of the plucked string (Plucked String) musical instruments may be simulated as long as the number of strings (number of the sensors), the base pitch of each string and the impacts of the input chord (note) data to each string are changed accordingly.

The foregoing contents are further and detailed description to the present invention with reference to the particular preferred embodiments, and shall not be construed as limiting the embodiments of the present invention to foregoing description. A person skilled in the art may also make a plurality of simple deductions or replacements, without departing from the concept of the present invention, which shall all fall into the protection scope of the present invention.

What is claimed is:

1. A plucked string performance data generation device, comprising:

a MIDI input interface for receiving MIDI data;

a plurality of infrared emitters and a plurality of infrared receivers for forming infrared strings distributed radially in form of a sector;

a microcontroller for generating MIDI data from chord data acquired from the MIDI input interface and interrupt data of the infrared strings;

a MIDI output interface connected with the microcontroller; and touch pads connected with the microcontroller and used for detecting pressing velocity of the touch pads;

wherein the touch pads are mounted onto respective infrared receivers.

2. The plucked string performance data generation device according to claim 1, further comprising a mute switch connected with the microcontroller, wherein the mute switch is mounted at a position adjacent to the plurality of infrared emitters.

3. The plucked string performance data generation device according to claim 2, further comprising a bass string touch pad connected with the microcontroller and used for detecting pressing velocity of the bass string touch pad, wherein the bass string touch pad is mounted onto an infrared emitter of the mute switch.

4. The plucked string performance data generation device according to claim 1, further comprising a sustain knob connected with the microcontroller and used for controlling a note sustain time.

5. The plucked string performance data generation device according to claim 1, further comprising a string velocity knob connected with the microcontroller and used for controlling a maximum down beat note velocity for plucking infrared strings.

6. The plucked string performance data generation device according to claim 1, further comprising a pad velocity knob connected with the microcontroller and used for controlling a maximum note velocity of the touch pad.

7. The plucked string performance data generation device according to claim 1, further comprising a keyboard control mode selection switch connected with the microcontroller.

8. The plucked string performance data generation device according to claim 1, wherein a distance between adjacent infrared emitters is between 0.7 cm and 1.7 cm; a distance between adjacent infrared receivers is between 1.5 cm and 3.0 cm; and a length of each of infrared strings is between 3.5 cm and 7.5 cm.

9. The plucked string performance data generation device according to claim 1, wherein an outer diameter of the touch pad is between 0.8 cm and 2.0 cm.

* * * * *